US010096893B2

(12) United States Patent
Ameri

(10) Patent No.: US 10,096,893 B2
(45) Date of Patent: Oct. 9, 2018

(54) PATCH ANTENNAS

(71) Applicant: Laird Technologies, Inc., Earth City, MO (US)

(72) Inventor: Ahmed A. H. Ameri, Hessen (DE)

(73) Assignee: LAIRD TECHNOLOGIES, INC., Earth City, MO (US)

( * ) Notice: Subject to any disclaimer, the term of this patent is extended or adjusted under 35 U.S.C. 154(b) by 154 days.

(21) Appl. No.: 15/375,370

(22) Filed: Dec. 12, 2016

(65) Prior Publication Data

US 2018/0159208 A1 Jun. 7, 2018

Related U.S. Application Data

(60) Provisional application No. 62/429,300, filed on Dec. 2, 2016.

(51) Int. Cl.

| | |
|---|---|
| ***H01Q 1/32*** | (2006.01) |
| ***H01Q 9/04*** | (2006.01) |
| ***H01Q 21/28*** | (2006.01) |
| *H01Q 1/42* | (2006.01) |
| *H01Q 1/38* | (2006.01) |
| *H01Q 1/12* | (2006.01) |

(52) U.S. Cl.
CPC ..... *H01Q 1/3275* (2013.01); *H01Q 9/0414* (2013.01); *H01Q 21/28* (2013.01); *H01Q 1/1214* (2013.01); *H01Q 1/38* (2013.01); *H01Q 1/42* (2013.01)

(58) Field of Classification Search
CPC ..... H01Q 1/24; H01Q 1/38; H01Q 21/28; H01Q 1/3275
USPC ..... 343/713, 700 MS
See application file for complete search history.

(56) References Cited

U.S. PATENT DOCUMENTS

| | | | | |
|---|---|---|---|---|
| 5,952,975 | A * | 9/1999 | Pedersen | H01Q 9/0421 343/700 MS |
| 5,986,609 | A * | 11/1999 | Spall | H01Q 1/243 343/700 MS |
| 6,133,880 | A * | 10/2000 | Grangeat | H01P 5/08 343/700 MS |
| 7,164,385 | B2 | 1/2007 | Duzdar et al. | |
| 7,295,167 | B2 | 11/2007 | Aminzadeh et al. | |
| 7,489,280 | B2 | 2/2009 | Aminzadeh et al. | |
| 8,738,103 | B2 * | 5/2014 | Puente Baliarda | H01Q 1/243 455/575.7 |
| 2004/0196190 | A1 * | 10/2004 | Mendolia | H01Q 1/085 343/700 MS |
| 2014/0285382 | A1 * | 9/2014 | Dobric | H01Q 9/0414 343/700 MS |
| 2015/0194728 | A1 * | 7/2015 | Piau | H01Q 1/286 343/841 |

* cited by examiner

*Primary Examiner* — Huedung X Mancuso
(74) *Attorney, Agent, or Firm* — Harness, Dickey & Pierce, P.L.C.; Anthony G. Fussner

(57) ABSTRACT

According to various aspects, exemplary embodiments are disclosed herein of patch antennas, stacked patch antenna assemblies, and vehicular antenna assemblies including the same. In exemplary embodiments, a patch antenna generally includes a dielectric substrate having a bottom, a top, and sides extending generally between the top and bottom of the dielectric substrate. A ground is along the bottom of the dielectric substrate. An antenna structure is along the top of the dielectric substrate. The antenna structure also extends at least partially along one or more sides of the dielectric substrate.

20 Claims, 10 Drawing Sheets

| | MIN | MAX |
|---|---|---|
| - - - F1559 E30 RC | -8.02 | 3.62 |
| —— F1606 E30 RC | -4.94 | 2.11 |
| - - - F1559 E60 RC | -1.31 | 3.45 |
| —— F1606 E60 RC | 0.32 | 2.78 |
| - - - F1559 E90 RC | 3.25 | 3.25 |
| —— F1606 E90 RC | 3.83 | 3.83 |

PATCH ANTENNAS

CROSS-REFERENCE TO RELATED APPLICATION

This application claims the benefit and priority of U.S. Provisional Patent Application No. 62/429,300 filed Dec. 2, 2016. The entire disclosure of the above application is incorporated herein by reference.

FIELD

The present disclosure generally relates to patch antennas, such as Global Navigation Satellite System (GNSS) patch antennas for automotive applications and vehicular antenna assemblies including patch antennas, etc.

BACKGROUND

This section provides background information related to the present disclosure which is not necessarily prior art.

Various different types of antennas are used in the automotive industry, including AM/FM radio antennas, Satellite Digital Audio Radio Service (SDARS) antennas (e.g., SiriusXM satellite radio, etc.), Global Navigation Satellite System (GNSS) antennas, cellular antennas, etc. Multiband antenna assemblies are also commonly used in the automotive industry. A multiband antenna assembly typically includes multiple antennas to cover and operate at multiple frequency ranges.

Automotive antennas may be installed or mounted on a vehicle surface, such as the roof, trunk, or hood of the vehicle to help ensure that the antennas have unobstructed views overhead or toward the zenith. The antenna may be connected (e.g., via a coaxial cable, etc.) to one or more electronic devices (e.g., a radio receiver, a touchscreen display, navigation device, cellular phone, etc.) inside the passenger compartment of the vehicle, such that the multiband antenna assembly is operable for transmitting and/or receiving signals to/from the electronic device(s) inside the vehicle.

DRAWINGS

The drawings described herein are for illustrative purposes only of selected embodiments and not all possible implementations, and are not intended to limit the scope of the present disclosure.

Figure 8:
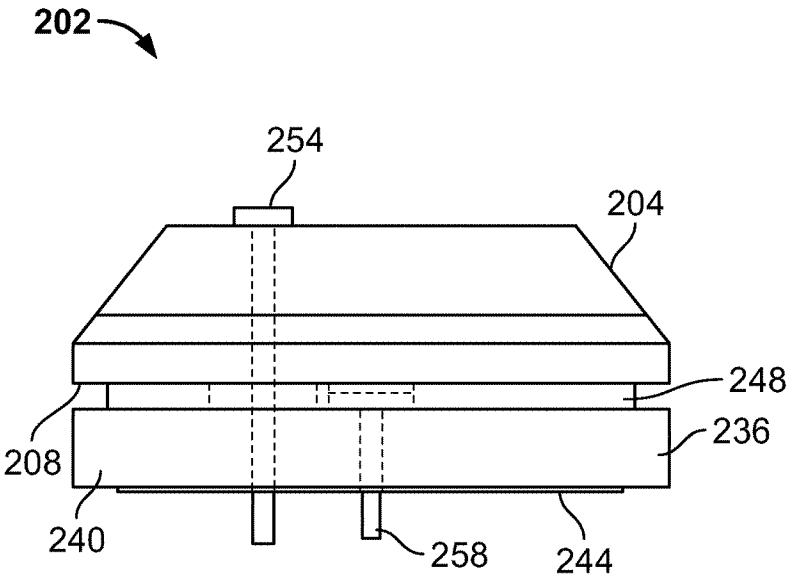
FIG. 8 is a side view of the stacked patch antenna assembly shown in FIG. 7.
Figure 7:
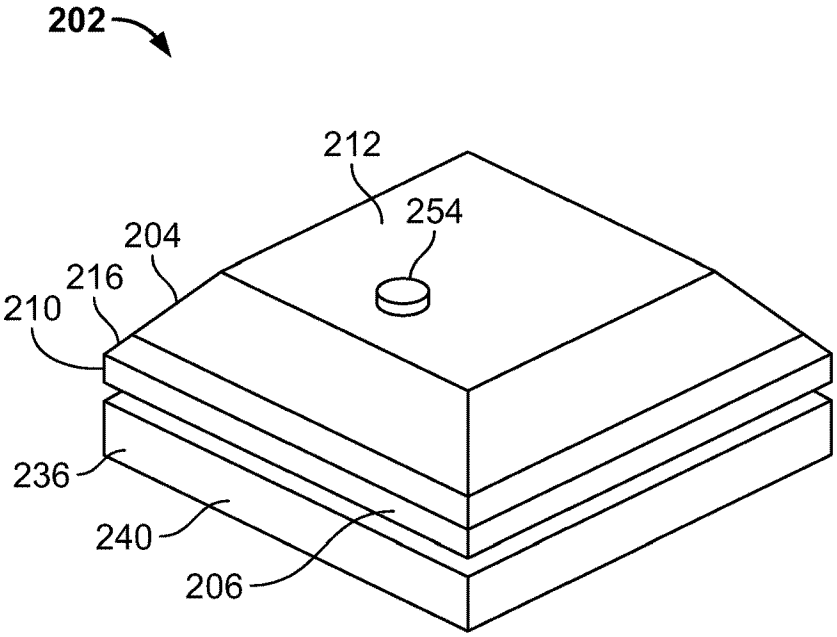
FIG. 7 is a perspective view of an exemplary embodiment of a stacked patch antenna assembly including a GNSS patch antenna stacked on top of a SDARS patch antenna.
Figure 9:
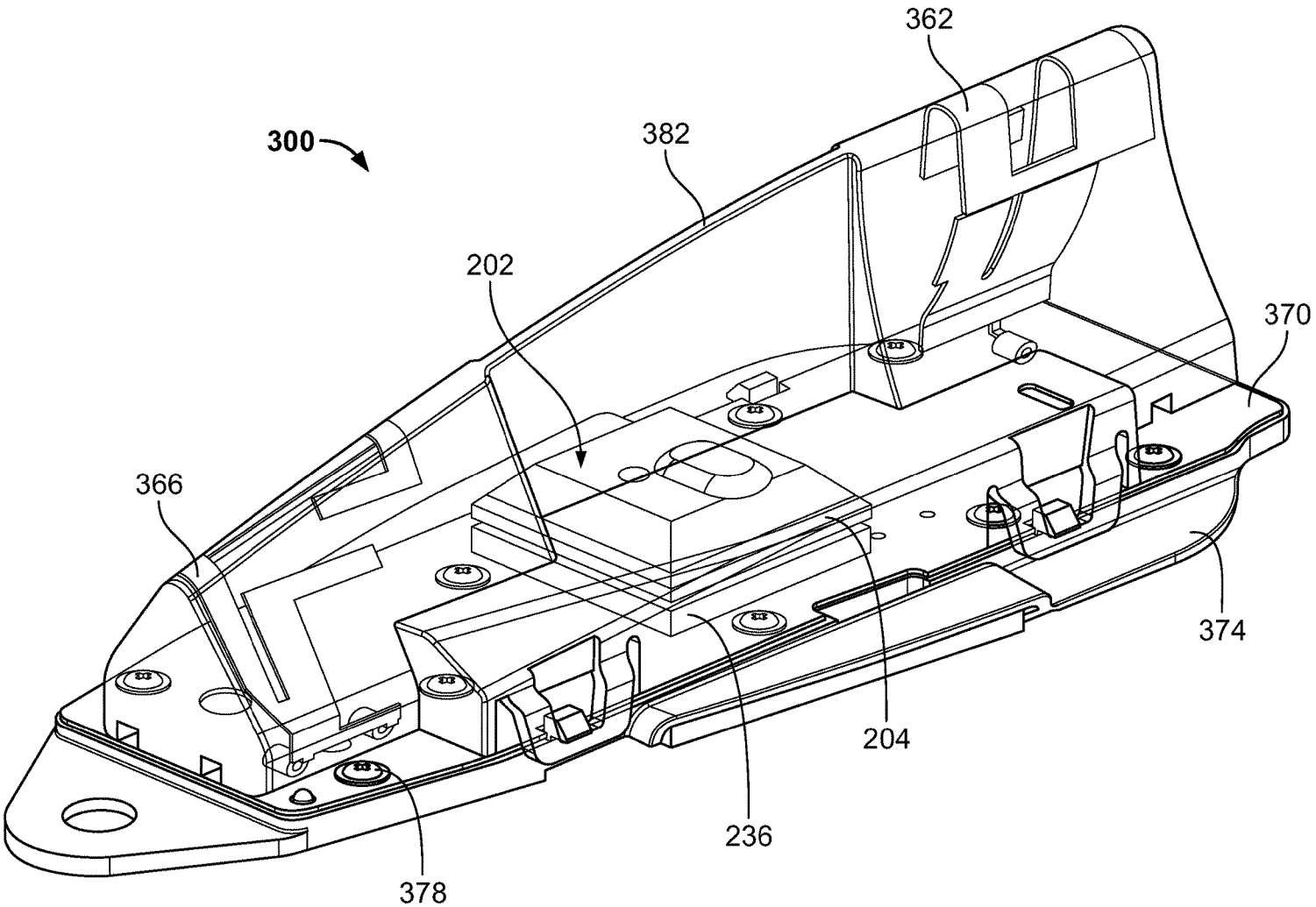
FIG. 9 is a perspective view of an exemplary embodiment of a multiband multiple input multiple output (MIMO) vehicular roof-mount antenna assembly that includes the stacked patch antenna assembly shown in FIGS. 7 and 8.
Figure 12:
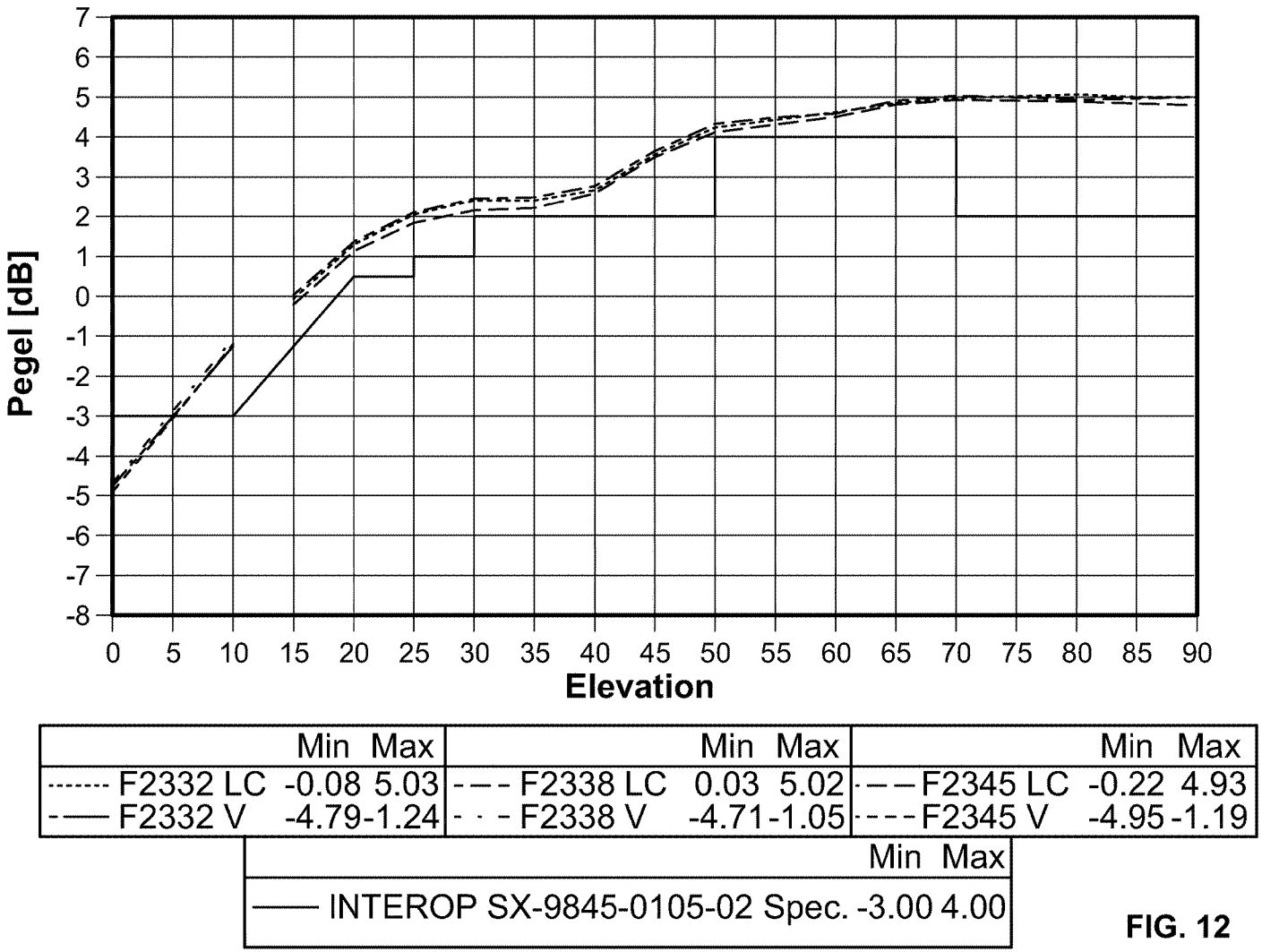
Figure 13:
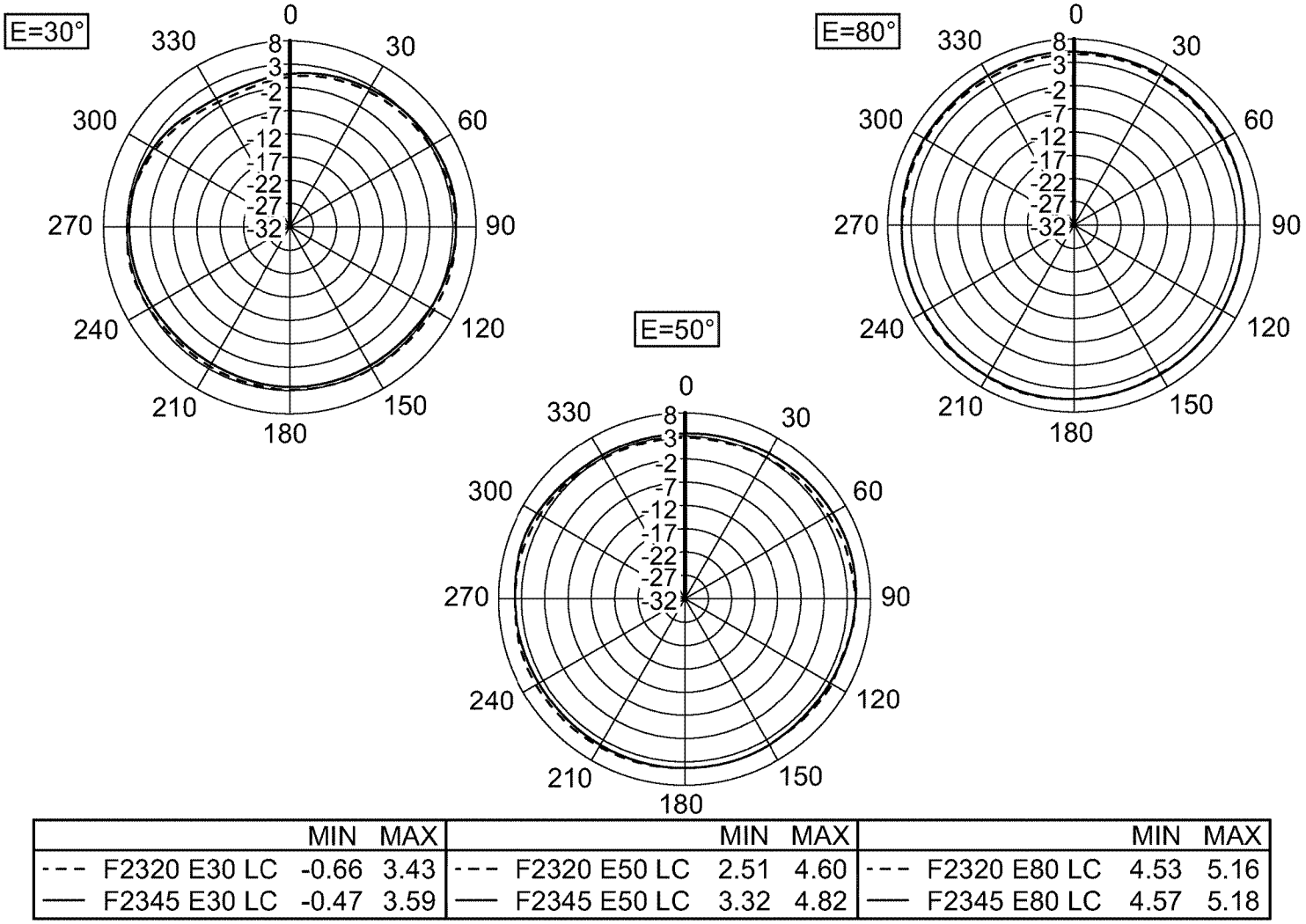

FIG. 12 is a line graph of average gain in decibels isotropic circular (dBic) versus elevation angle in degrees for the SDARS patch antenna shown in FIGS. 7 through 9 at SDARS frequencies of 2332 MHz, 2338 MHz, and 2345 MHz with left circular (LC) polarization for elevation angles from 15 degrees to 90 degrees and vertical (V) polarization for elevation angles from 0 degrees to 10 degrees; and FIG. 13 illustrates radiation patterns of the SDARS patch antenna shown in FIGS. 7 through 9 at SDARS frequencies of 2320 MHz and 2345 MHz, at elevation angles of 30 degrees, 60 degrees, and 90 degrees with left circular (LC) polarization.

Corresponding reference numerals indicate corresponding parts throughout the several views of the drawings.

DETAILED DESCRIPTION

Example embodiments will now be described more fully with reference to the accompanying drawings.

Satellite navigation systems have become an integral part of applications (e.g., automotive applications, vehicular antenna assemblies, etc.) for which mobility plays an important role. Satellite signals broadcasted from multiple navigation satellite systems (e.g., GPS (Global Positioning System, GLONASS (GLObal Navigation Satellite System), Galileo, and BeiDou (Compass), etc.) may preferably be used to achieve higher position accuracy and to improve the success rate of positioning. A broadband antenna with a frequency band of about 50 MHz from about 1559 MHz to about 1610 MHz may preferably be used to receive the satellite navigation signals from these different systems.

For automotive applications, relatively small or compact antennas are preferably used in vehicular antenna assemblies. In satellite navigation systems, patch antennas are widely used due to their compact size and ease of implementation.

Figure 2:
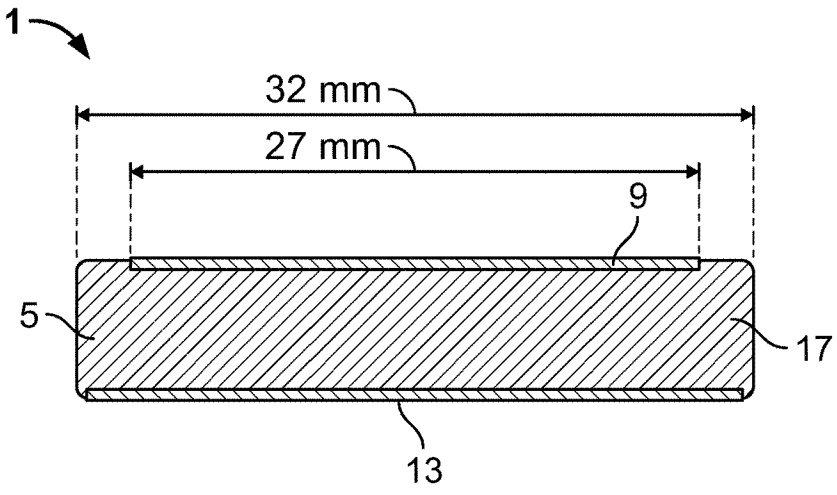
FIG. 2 is side view of the conventional patch antenna shown in FIG. 1.
Figure 1:
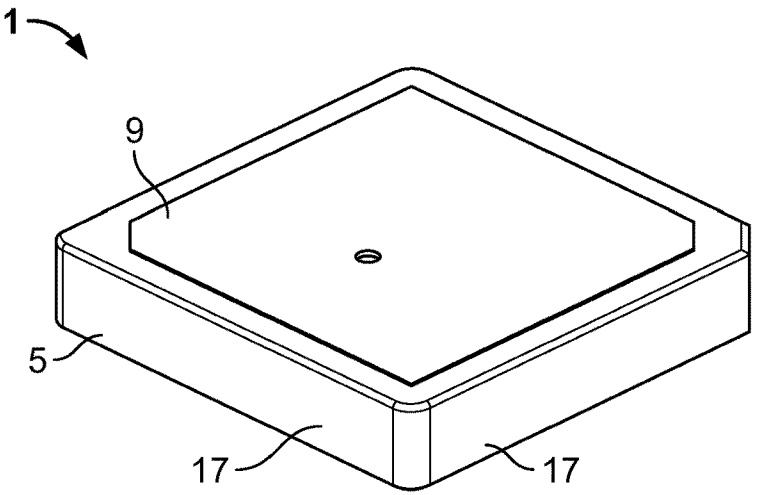
FIG. 1 is a perspective view of a conventional rectangular patch antenna.

For example, FIGS. 1 and 2 illustrate a conventional patch antenna 1 including a dielectric substrate 5, a top metallization 9 along the top surface of the substrate 5, and a bottom metallization 13 along the bottom surface of the substrate 5. The conventional patch antenna 1 is relatively compact with an overall length and width of 32 millimeters (mm) and a total thickness of 7 mm. The top metallization 9 has an overall length and width of 27 mm. The patch antenna 1 has a material dielectric constant of 15.

Figure 3:
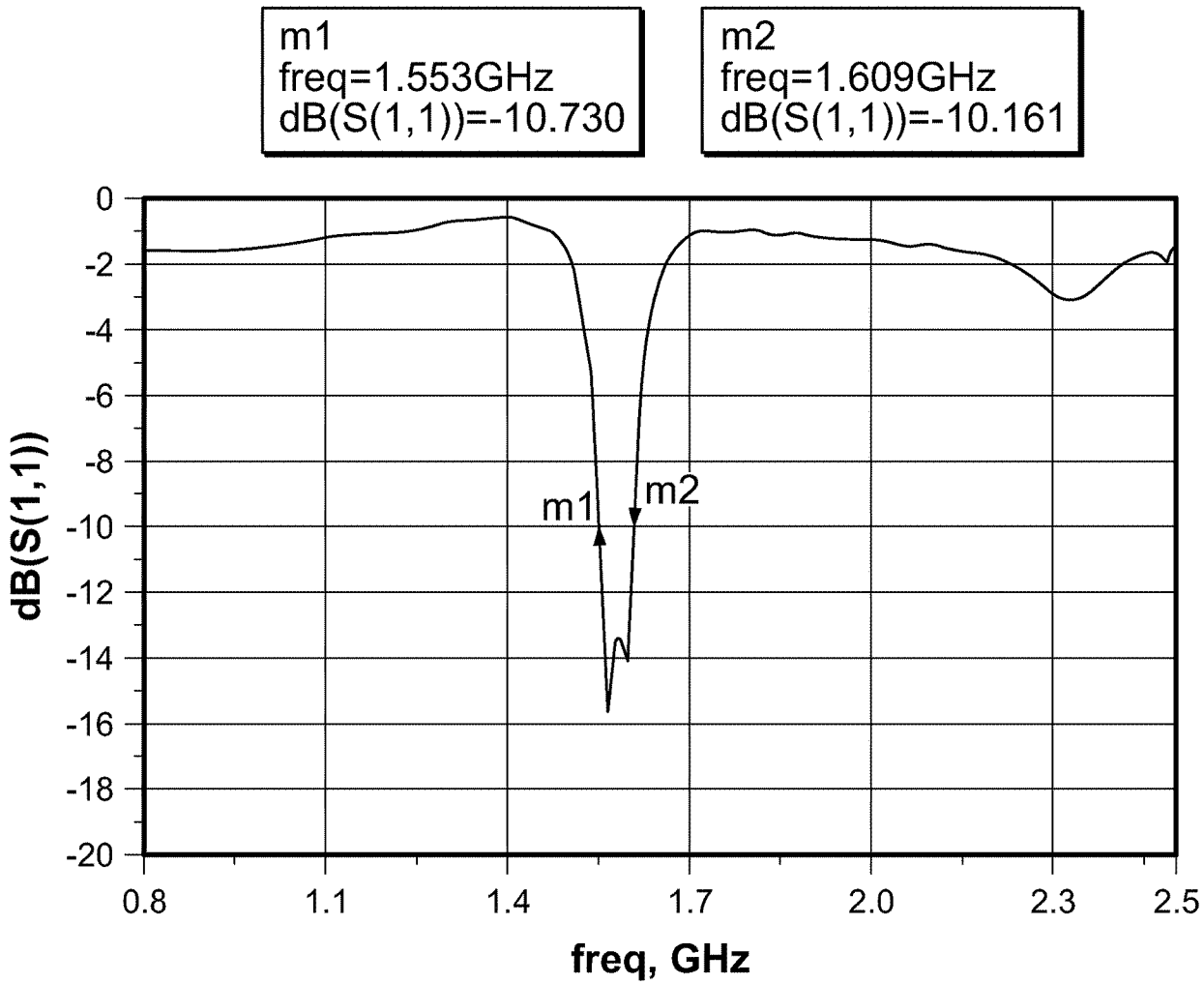
FIG. 3 is a line graph of reflection coefficient ($S_{11}$) in decibels (dB) versus frequency in gigahertz (GHz) for the conventional patch antenna shown in FIGS. 1 and 2.

FIG. 3 is a line graph of reflection coefficient ($S_{11}$) in decibels (dB) versus frequency in gigahertz (GHz) for the conventional patch antenna 1 shown in FIGS. 1 and 2. As shown, the patch antenna 1 has a frequency band of about 56 MHz defined at a reflection coefficient ($S_{11}$) less than or equal to negative ten decibels ($S_{11} \leq -10$ dB). More specifically, the patch antenna 1 had a reflection coefficient ($S_{11}$) less or equal to about −10 dB from about 1.553 GHz at which $S_{11}$ was about −10.730 dB to about 1.609 GHz at which $S_{11}$ was about −10.161 dB.

Although the patch antenna 1 may work well for some applications, the patch antenna 1 may have a relatively low impedance bandwidth. The bandwidth of the patch antenna 1 may be increased by reducing the dielectric constant ($\varepsilon_r$) of the patch substrate material or by increasing the height of the patch antenna 1. But reducing the dielectric constant of the patch substrate material would require the size of the conventional patch antenna 1 to be increased in order to maintain the resonant frequency. And, the available space under a radome of a vehicular antenna assembly is usually very limited.

Disclosed herein are exemplary embodiments of patch antennas that have modified configurations (e.g., shapes, sizes, etc.) that allow for a reduced size while maintaining a good frequency bandwidth. For example, an exemplary embodiment of a broadband GNSS patch antenna (e.g., patch antenna 104 in FIGS. 3 and 4, etc.) is disclosed that has a smaller overall size (e.g., 25 mm×25 mm×7 mm, etc.) than the 32 mm×32 mm×7 mm size of the conventional patch antenna 1 shown in FIG. 2. For example, the modified configuration of the broadband GNSS patch antenna may allow for a significant reduction (e.g., about 31 percent, etc.) in the size and cost of the broadband GNSS patch antenna as compared to the conventional patch antenna 1.

The broadband GNSS patch antenna may have a frequency bandwidth of at least about 50 MHz from about 1559 MHz to about 1610 MHz. Accordingly, the broadband GNSS patch antenna may be used to receive the satellite navigation signals from different satellite navigation systems. Aspects of the present disclosure, however, should not be limited to only patch antennas configured for use with satellite navigation systems as aspects of the present disclosure are applicable to other patch antennas configured for use with different services and different frequencies other than GNSS.

The broadband GNSS patch antenna includes a dielectric substrate (e.g., a ceramic or other dielectric material, etc.), a ground (e.g., metallization or other electrically-conductive material, etc.) along the bottom of the dielectric substrate, and an antenna structure or radiating element (e.g., metallization or other electrically-conductive material, $\lambda/2$ antenna structure, etc.) along the top and partially along first or upper side portions of the dielectric substrate. The bottom of the dielectric substrate includes or defines a generally flat or planar bottom surface of the dielectric substrate. The top of the dielectric substrate defines or includes a generally flat or planar top surface that is generally parallel with the bottom surface of the dielectric substrate.

The upper side portions of the dielectric substrate (along which the antenna structure partially extends) extend linearly from the edges of the top surface. The upper side portions are non-parallel with each other and are slanted or angled outwardly at an obtuse angle (e.g., about 60 degrees, etc.) relative to the top surface of the dielectric substrate.

The dielectric substrate also includes second or lower side portions that extend linearly between the upper side portions and the bottom of the dielectric substrate. The lower side portions are generally parallel to each other and generally perpendicular to the bottom surface of the dielectric substrate. Each of the four sides of the dielectric substrate has a generally hexagonal perimeter. The hexagonally shaped perimeter is cooperatively defined by an edge of the top surface, an edge of the bottom surface, and opposing pairs of the upper and lower side portions of the dielectric substrate. The top and bottom surfaces of the dielectric substrate may each have a square perimeter. The perimeter of the bottom surface is larger than the perimeter of the top surface.

The bottom portion of the dielectric substrate including the lower side portions may cooperatively define a rectangular prism, cuboid, square base, etc. The top portion of the dielectric substrate including the upper side portions may cooperatively define a truncated square pyramid, truncated right regular pyramid, right frustum, square frustum, pyramidal frustum of a square pyramid, etc.

The ground or bottom metallization of the broadband GNSS patch antenna may be disposed along the entire bottom surface of the dielectric substrate. The antenna structure, radiating element, or top metallization may also be disposed along or across the entire top surface of the dielectric substrate. The antenna structure, radiating element, or top metallization may also extend partially downward along the upper side portions of the dielectric substrate. Accordingly, the antenna structure, radiating element, or top metallization has a non-flat or non-planar configuration.

The upper side portions of the dielectric substrate are configured to approach or be less spaced apart from each other (e.g., tapered, angled or slanted inwardly toward each other, etc.) in a bottom-to-top direction towards the top surface. With this configuration, the dielectric substrate tapers or reduces in width and length along the upper side portions such that the perimeter and surface area of the top surface of the dielectric substrate are smaller than the perimeter and surface area of the bottom surface of dielectric substrate.

With the antenna structure extensions along the upper side portions of the dielectric substrate, the antenna structure has a significantly larger surface area than the surface area of the top surface of the dielectric substrate. The extensions of the antenna structure along the upper side portions of the dielectric substrate increase the electrical length of the antenna structure. This helps allow the broadband GNSS patch antenna to have a good frequency bandwidth (e.g., about 50 MHz from about 1559 MHz to about 1610 MHz, etc.) despite having a reduced overall size (e.g., 25 mm length and 25 mm width as shown in FIG. 5, etc.).

By comparison, the conventional patch antenna 1 shown in FIGS. 1 and 2 includes a dielectric substrate 5 configured as a rectangular prism or cuboid. The top metallization 9 is flat, planar, and extends only across a portion (not the entirety) of the top surface of the dielectric substrate 5. The top metallization 9 does not extend downward along any portion of the four sides 17 of the dielectric substrate 5.

Also disclosed are exemplary embodiments of stacked patch antenna assemblies (e.g., stacked patch assembly 202 shown in FIGS. 7 and 8, etc.) that include a first or upper patch antenna (e.g., patch antenna 104 in FIGS. 3 and 4, patch antenna 104 in FIGS. 7 and 8, etc.) stacked on top of a second or lower patch antenna (e.g., an SDARS patch antenna 236 shown in FIGS. 7 and 8, etc.). Exemplary embodiments are also disclosed of multiband multiple input multiple output (MIMO) vehicular antenna assemblies (e.g., multiband MIMO vehicular roof-mount antenna assembly 300 shown in FIG. 9, etc.) that include a stacked patch antenna assembly (e.g., stacked patch antenna assembly 202 shown in FIGS. 7 and 8, etc.).

Figure 5:
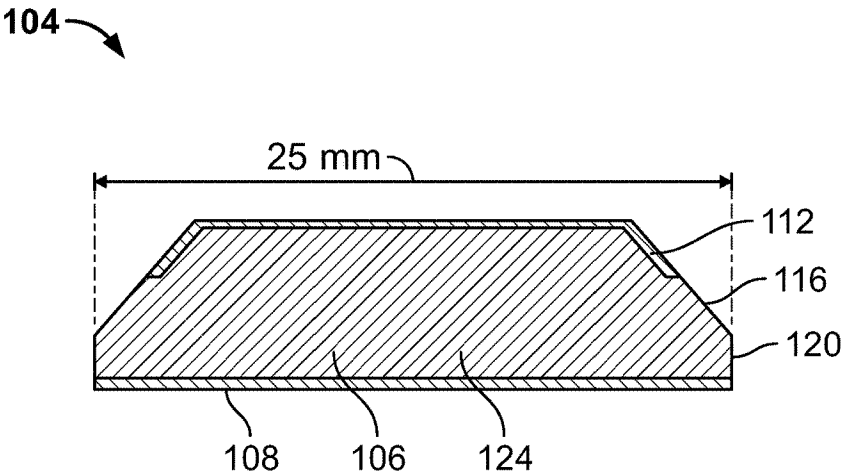
FIG. 5 is a side view of the GNSS patch antenna shown in FIG. 4 with an exemplary width dimension provided in millimeters.
Figure 4:
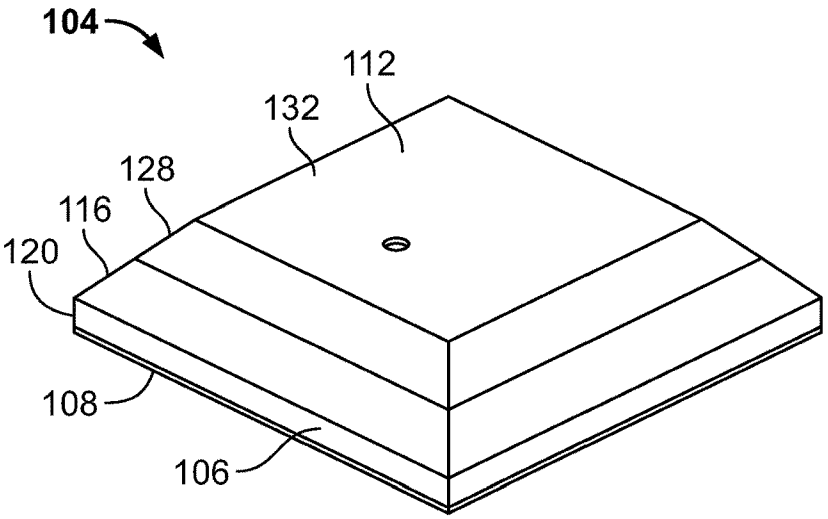
FIG. 4 is a perspective view of a GNSS (Global Navigation Satellite System) patch antenna according to an exemplary embodiment.

FIGS. 4 and 5 illustrate an exemplary embodiment of a patch antenna 104 embodying one or more aspects of the present disclosure. As shown in FIGS. 1 and 2, the patch antenna 104 includes a dielectric substrate 106 (e.g., a ceramic or other dielectric material, etc.). A ground 108 (e.g., metallization or other electrically-conductive material, etc.) is disposed along a bottom of the dielectric substrate 106. An antenna structure or radiating element 112 (e.g., metallization or other electrically-conductive material, λ/2 antenna structure, etc.) is disposed along a top of the dielectric substrate 106. The antenna structure 112 also extends partially along first or upper side portions 116 of the dielectric substrate 106.

The bottom of the dielectric substrate 106 defines a generally flat or planar bottom surface of the dielectric substrate 106. The top of the dielectric substrate 106 defines a generally flat or planar top surface that is generally parallel with the bottom surface of the dielectric substrate 106.

The upper side portions 116 of the dielectric substrate 106 extend linearly from the corresponding side edges of the top surface. The upper side portions 116 are non-parallel with each other and are slanted or angled outwardly at an obtuse angle (e.g., about 60 degrees, etc.) relative to the top surface of the dielectric substrate 106.

The dielectric substrate 106 also includes second or lower side portions 120 that extend linearly between the upper side portions 116 and the bottom surface of the dielectric substrate 106. The lower side portions 120 are generally parallel with each other and generally perpendicular to the bottom surface of the dielectric substrate 106. As shown in FIG. 5, each of the four sides 124 of the dielectric substrate 106 has a generally hexagonal perimeter. The hexagonally shaped perimeter is cooperatively defined by an edge of the top surface, an edge of the bottom surface, and opposing pairs of the upper side portions 116 and lower side portions 120. Stated differently, each side 124 of the dielectric substrate 106 may have a lower rectangular portion with a rectangular perimeter and an upper trapezoidal portion with a trapezoidal perimeter.

The top surface of the dielectric substrate 106 may have a square perimeter. The bottom surface of the dielectric substrate 106 may also have a square perimeter. The perimeter of the bottom surface is larger than the perimeter of the top surface.

The bottom portion of the dielectric substrate 106 including the lower side portions 120 may cooperatively define a rectangular prism, cuboid, square base, etc. The top portion of the dielectric substrate 106 including the upper side portions 116 may cooperatively define a truncated square pyramid, truncated right regular pyramid, right frustum, square frustum, pyramidal frustum of a square pyramid, etc. Stated differently, the dielectric substrate 106 may have a first or upper portion that is shaped as a rectangular prism or cuboid and second or lower portion that is shaped as a truncated square pyramid, truncated right regular pyramid, right frustum, square frustum, pyramidal frustum of a square pyramid.

As shown in FIG. 5, the ground 108 of the patch antenna 104 may be disposed along the entire bottom surface of the dielectric substrate 106. The antenna structure 112 may be disposed along or across the entire top surface of the dielectric substrate 106. The antenna structure 112 also extends downward partially along the upper side portions 116 of the dielectric substrate 106. The antenna structure 112 thus has a non-flat or non-planar configuration.

The extent to which the antenna structure 112 extends (e.g., partially, entirely, etc.) along the upper side portions 116 may depend on the particular end use, e.g., particular frequencies, available space under the radome, etc. In other exemplary embodiments, the antenna structure may extend over more or less of the upper side portions than what is shown in FIGS. 4 and 5. For example, the patch antenna 204 shown in FIGS. 7 and 8 includes an antenna structure 212 that extends farther down along the upper side portions 216 of the dielectric substrate 206 than does the antenna structure 112. As another example, the antenna structure may extend completely over the upper side portions of the dielectric substrate without extending downwardly along the lower side portions of the dielectric substrate. As a further example, the antenna structure may extend completely over the upper side portions and partially or completely along the lower side portions of the dielectric substrate.

The upper side portions 116 of the dielectric substrate 106 are angled inwardly toward each other in a direction (from bottom to top in FIG. 5) towards the top surface. With this configuration, the dielectric substrate 106 tapers or reduces in width and length along the upper side portions 116 such that the perimeter and surface area of the top surface of the dielectric substrate 106 are smaller than the perimeter and surface area of the bottom surface of dielectric substrate 106.

With the antenna structure's extensions 128 along the upper side portions 116 of the dielectric substrate 106, the antenna structure 112 has an overall surface area larger than the surface area of the top surface of the dielectric substrate 106. The extensions 128 of the antenna structure 112 along the upper side portions 116 of the dielectric substrate 106 increase the overall electrical length of the antenna structure 112 as compared to the electrical length of only the portion 132 of the antenna structure 112 disposed along the top surface of the dielectric substrate 106. The modified configuration of the patch antenna 104 enables a relatively small overall size (e.g., 25 mm×25 mm×7 mm, etc.) and a good frequency band (e.g., of at least about 50 MHz, etc.). By way of example, the electrically-conductive material used to form the antenna structure 112 (e.g., λ/2-antenna structure, etc.) may comprise silver, etc.

Figure 6:
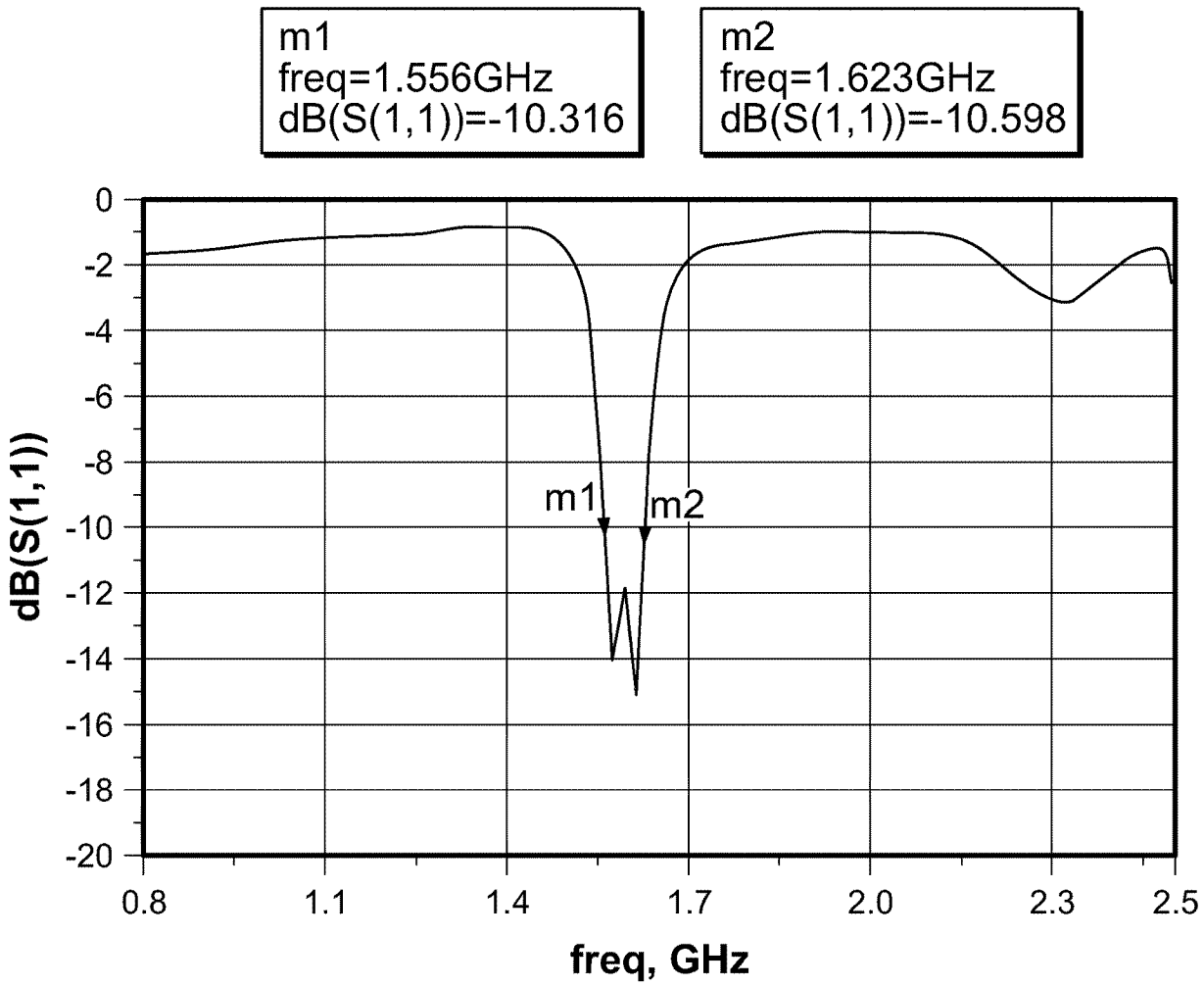
FIG. 6 is a line graph of reflection coefficient ($S_{11}$) in decibels (dB) versus frequency in gigahertz (GHz) for the GNSS patch antenna shown in FIGS. 4 and 5.

FIG. 6 is a line graph of reflection coefficient ($S_{11}$) in decibels (dB) versus frequency in gigahertz (GHz) for the patch antenna 104 shown in FIGS. 4 and 5. As shown, the patch antenna 104 has a frequency band of at least about 50 MHz defined at a reflection coefficient ($S_{11}$) less than or equal to negative ten decibels ($S_{11} \leq -10$ dB). More specifically, the patch antenna 104 had a reflection coefficient ($S_{11}$) less or equal to about −10 dB from about 1.555 GHz at which $S_{11}$ was about −10.316 dB to about 1.623 GHz at which $S_{11}$ was about −10.598 dB. The results shown in FIG. 6 are provided only for purposes of illustration and not for purposes of limitation. In alternative embodiments, the patch antenna 104 may be configured differently and have different operational or performance parameters than what is shown in FIG. 6.

Accordingly, the patch antenna 104 may be used as a broadband GNSS patch antenna for receiving satellite navigation signals from different satellite navigation systems. Aspects of the present disclosure, however, should not be limited to patch antennas configured for use with only satellite navigation systems as aspects of the present disclosure are applicable to other patch antennas configured for use with different services and different frequencies other than GNSS.

FIGS. 7 and 8 illustrate an exemplary embodiment of a stacked patch antenna assembly 202 embodying one or more aspects of the present disclosure. As shown in FIGS. 7 and 8, the stacked patch antenna assembly 202 includes a first or upper patch antenna 204 stacked on top of a second or lower patch antenna 236.

The first or upper patch antenna 204 may be similar or identical to the patch antenna 104 shown in FIGS. 4 and 5.

For example, the first or upper patch antenna 204 may also include a dielectric substrate 206 (e.g., a ceramic or other dielectric material, etc.), a ground 208 (e.g., metallization, etc.), and an antenna structure or radiating element 212 (e.g., metallization, λ/2 antenna structure, etc.) similar to the corresponding dielectric substrate 106, ground 108, and antenna structure 112 of the patch antenna 104.

The dielectric substrate 206 may be shaped and sized similar to the dielectric substrate 106. For example, the dielectric substrate 206 also includes generally flat or planar bottom and top parallel surfaces, first or upper side portions 216, and second or lower side portions 220. The upper side portions 216 extend linearly from corresponding side edges of the top surface of the dielectric surface 206. The upper side portions 216 are non-parallel with each other and are slanted or angled outwardly at an obtuse angle (e.g., about 60 degrees, etc.) relative to the top surface of the dielectric substrate 206. The lower side portions 220 extend linearly between the upper side portions 216 and the bottom surface of the dielectric substrate 206. The lower side portions 220 are generally parallel with each other and generally perpendicular to the bottom surface of the dielectric substrate 206.

The upper side portions 216 of the dielectric substrate 206 are angled inwardly toward each other in a direction (from bottom to top in FIG. 7) towards the top surface. With this configuration, the dielectric substrate 206 tapers or reduces in width and length along the upper side portions 216 such that the perimeter and surface area of the top surface of the dielectric substrate 206 are smaller than the perimeter and surface area of the bottom surface of dielectric substrate 206.

The bottom portion of the dielectric substrate 206 including the lower side portions 220 may cooperatively define a rectangular prism, cuboid, square base, etc. The top portion of the dielectric substrate 206 including the upper side portions 216 may cooperatively define a truncated square pyramid, truncated right regular pyramid, right frustum, square frustum, pyramidal frustum of a square pyramid, etc. Stated differently, the dielectric substrate 206 may have a first or upper portion that is shaped as a rectangular prism or cuboid and second or lower portion that is shaped as a truncated square pyramid, truncated right regular pyramid, right frustum, square frustum, pyramidal frustum of a square pyramid.

The antenna structure 212 may be disposed along or across the entire top surface of the dielectric substrate 206. The antenna structure 212 also extends downward partially along the upper side portions 216 of the dielectric substrate 206. The antenna structure 212 thus has a non-flat or non-planar configuration.

As shown in FIG. 8, the second or lower patch antenna 236 includes a dielectric substrate 240 (e.g., a ceramic or other dielectric material, etc.). A ground 244 (e.g., metallization, other electrically-conductive material, etc.) is disposed along a bottom of the dielectric substrate 240. An antenna structure or radiating element (e.g., metallization or other electrically-conductive material, λ/2 antenna structure, etc.) is disposed along a top of the dielectric substrate 206 beneath an adhesive 248.

The adhesive 248 is disposed between the upper and lower patch antennas 204, 236. The adhesive 248 is used to attach the upper patch antenna 204 to the lower patch antenna 236. Alternatively, other means may be used to attach the upper patch antenna 204 to the lower patch antenna 236.

FIG. 8 also shows connectors 254, 258 (e.g., pins or other interlayer connectors, etc.) that may be used to electrically connect the antenna structures of the patch antennas 204, 236 to a printed circuit board (PCB) (e.g., PCB 370 shown in FIG. 9, etc.). More specifically, the connector 254 is electrically coupled to the antenna structure 212 of the top patch antenna 204 and runs through the dielectric substrate 206 of the top patch antenna 204 and through the dielectric substrate 240 of the bottom patch antenna 236. The connector 258 is electrically coupled to the antenna structure of the bottom patch antenna 236 and runs through the dielectric substrate 240 of the bottom patch antenna 236.

By way of example, the first or top patch antenna 204 may be configured to be operable for receiving Global Navigation Satellite System (GNSS) signals or frequencies (e.g., Global Positioning System (GPS), BeiDou Navigation Satellite System (BDS), the Russian Global Navigation Satellite System (GLONASS), other satellite navigation system frequencies, etc.). The second or bottom patch antenna 236 may be configured to be operable for receiving SDARS signals (e.g., SiriusXM, etc.). Alternatively, either or both of the first and second patch antennas 204, 236 may be configured for use with different services and/or different frequencies.

FIG. 9 illustrates an exemplary embodiment of a multiband multiple input multiple output (MIMO) vehicular roof-mount antenna assembly 300 embodying one or more aspects of the present disclosure. As shown in FIG. 9, the antenna assembly 300 includes the stacked patch antenna assembly 202 shown in FIGS. 7 and 8, a first cellular antenna 362, and a second cellular antenna 366. The antenna assembly 300 may be operable as a multiband multiple input multiple output (MIMO) vehicular antenna assembly.

The antenna assembly 300 also includes a printed circuit board (PCB) 370 and chassis or base 374. The PCB 370 is supported by the chassis or base 374. In this example embodiment, the PCB 370 is mechanically fastened via fasteners 378 (e.g., screws, etc.) to the chassis 374. The stacked patch antenna 202, the first cellular antenna 362, and second cellular antenna 366 may be connected to and supported by the PCB 370.

As noted above, the first or top patch antenna 204 of the stacked patch antenna assembly 202 may be configured to be operable for receiving Global Navigation Satellite System (GNSS) signals or frequencies (e.g., Global Positioning System (GPS), BeiDou Navigation Satellite System (BDS), the Russian Global Navigation Satellite System (GLONASS), other satellite navigation system frequencies, etc.). The second or bottom patch antenna 236 of the stacked patch antenna assembly 202 may be configured to be operable for receiving SDARS signals (e.g., SiriusXM, etc.). In exemplary embodiments, the SDARS signals may be fed via a coaxial cable to a SDARS radio, which, in turn, may be located in an Instrument Panel (IP) that is independent from a Telematics Control Unit (TCU) box. By way of background, the frequency range or bandwidth of GPS(L1) is 1575.42 MHz±1.023 MHz, the frequency range or bandwidth of BDS(B1) is 1561.098 MHz±2.046 MHz, the frequency range or bandwidth of GLONASS(L1) is 1602.5625 MHz±4 MHz, and the frequency range or bandwidth of SDARS is 2320 MHz to 2345 MHz. Also, for example, the first patch antenna 204 may be operable from about 1558 MHz to about 1608 MHz.

In this illustrated embodiment, the first or primary cellular antenna 362 is configured to be operable for both receiving and transmitting communication signals within one or more cellular frequency bands (e.g., Long Term Evolution (LTE), LTE1, LTE2, etc.). The second or secondary cellular antenna 366 is configured to be operable for receiving (but not transmitting) communication signals within one or more cellular frequency bands (e.g., LTE1, LTE2, etc.).

The first and second cellular antennas 362, 366 comprise flex-foil copper sheets or flex film antennas. The first and second cellular antennas 362, 366 are disposed along and in conformance with the inner surface of back and front portions of a radome or cover 382. The first and second cellular antennas 362, 366 may be flexed, bent, curved, or otherwise shaped in conformance with a shape or contour of the inner surface of the radome 382 and attached (e.g., adhesively attached, pasted, etc.) to the inner surface of the radome 382. The first and second cellular antennas 362, 366 thus generally follow the shape or contour of the corresponding portion of the radome 382 along which they are positioned.

Alternative embodiments may include a first and/or second cellular antenna that is configured differently (e.g., inverted L antenna (ILA), planar inverted F antenna (PIFA), an antenna made of different materials and/or via different manufacturing processes, etc.). For example, a two shot molding process, selective plating process, and/or laser direct structuring (LDS) process may be used to provide the first and second cellular antennas 362, 366 on the inner surface of the radome 382 in other exemplary embodiments. Or, for example, the first and second cellular antennas 362, 366 may comprise stamped and bent sheet metal (e.g., a stamped metal wide band monopole antenna mast, etc.) in alternative embodiments. The second cellular antenna 366 may be configured to transmit in a different channel (Dual Channel feature) or transmit at the same channel but at a different time slot (Tx Diversity).

The radome or cover 382 is provided to help protect the various components of the antenna assembly 300 enclosed within an interior spaced defined by the radome 382 and the chassis 374. For example, the radome 382 may substantially seal the components of the antenna assembly 300 within the radome 382 thereby protecting the components against ingress of contaminants (e.g., dust, moisture, etc.) into an interior enclosure of the radome 382. In addition, the radome 382 may have an aesthetically pleasing, aerodynamic shark-fin configuration. The radome 382 is configured to be secured to the chassis 374, such as by a snap fit connection, snap clips, mechanical fasteners mechanical fasteners (e.g., screws, other fastening devices, etc.), ultrasonic welding, solvent welding, heat staking, latching, bayonet connections, hook connections, integrated fastening features, etc.

The chassis or base 374 may be configured to couple to a roof or other mounting surface (e.g., trunk lid, etc.) of a vehicle for installing the antenna assembly 300 to the vehicle. Alternatively, the radome 382 may connect directly to the mounting surface of a vehicle within the scope of the present disclosure.

FIGS. 10 through 13 provide analysis results for the stacked patch antenna assembly 202 shown in FIGS. 7 through 9. These results shown in FIGS. 10 through 13 are provided only for purposes of illustration and not for purposes of limitation. In alternative embodiments, the first and/or second patch antennas 204, 236 of the stacked patch antenna assembly 202 may be configured differently and have different operational or performance parameters than what is shown in FIGS. 10 through 13.

Figure 10:
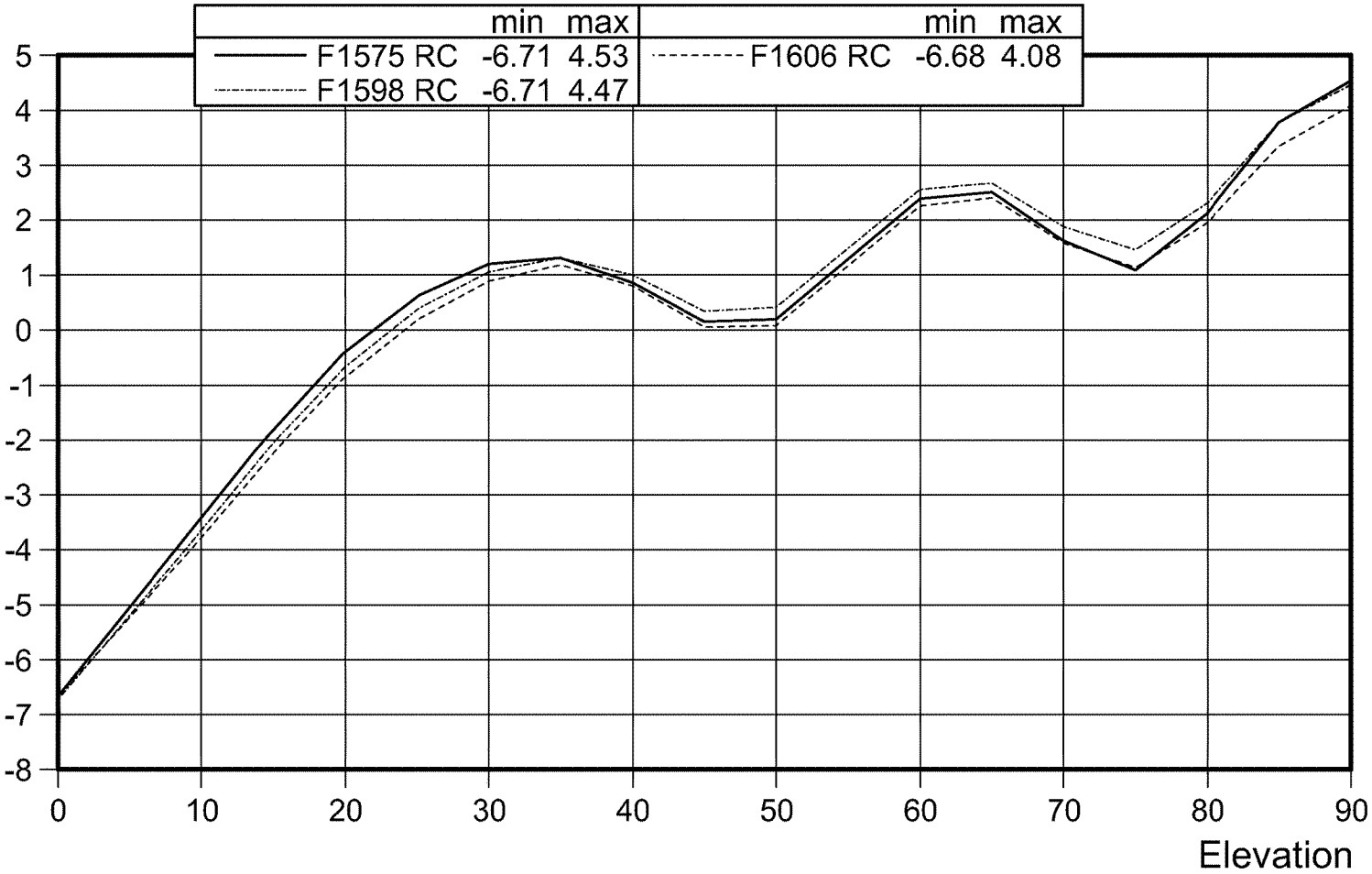
FIG. 10 is a line graph of average gain in decibels isotropic circular (dBic) versus elevation angle in degrees for the GNSS patch antenna shown in FIGS. 7 through 9 at GNSS frequencies of 1575 MHz, 1598 MHz, and 1606 MHz with right circular (RC) polarization.

FIG. 10 is a line graph of average gain in decibels isotropic circular (dBic) versus elevation angle in degrees for the top patch antenna 204 shown in FIGS. 7 through 9 at GNSS frequencies of 1575 MHz, 1598 MHz, and 1606 MHz with right circular (RC) polarization. Generally, FIG. 10 shows that the upper patch antenna 204 had good average gain of at least −7 dBic at these GNSS frequencies for elevation angles greater than 0 degrees.

Figure 11:
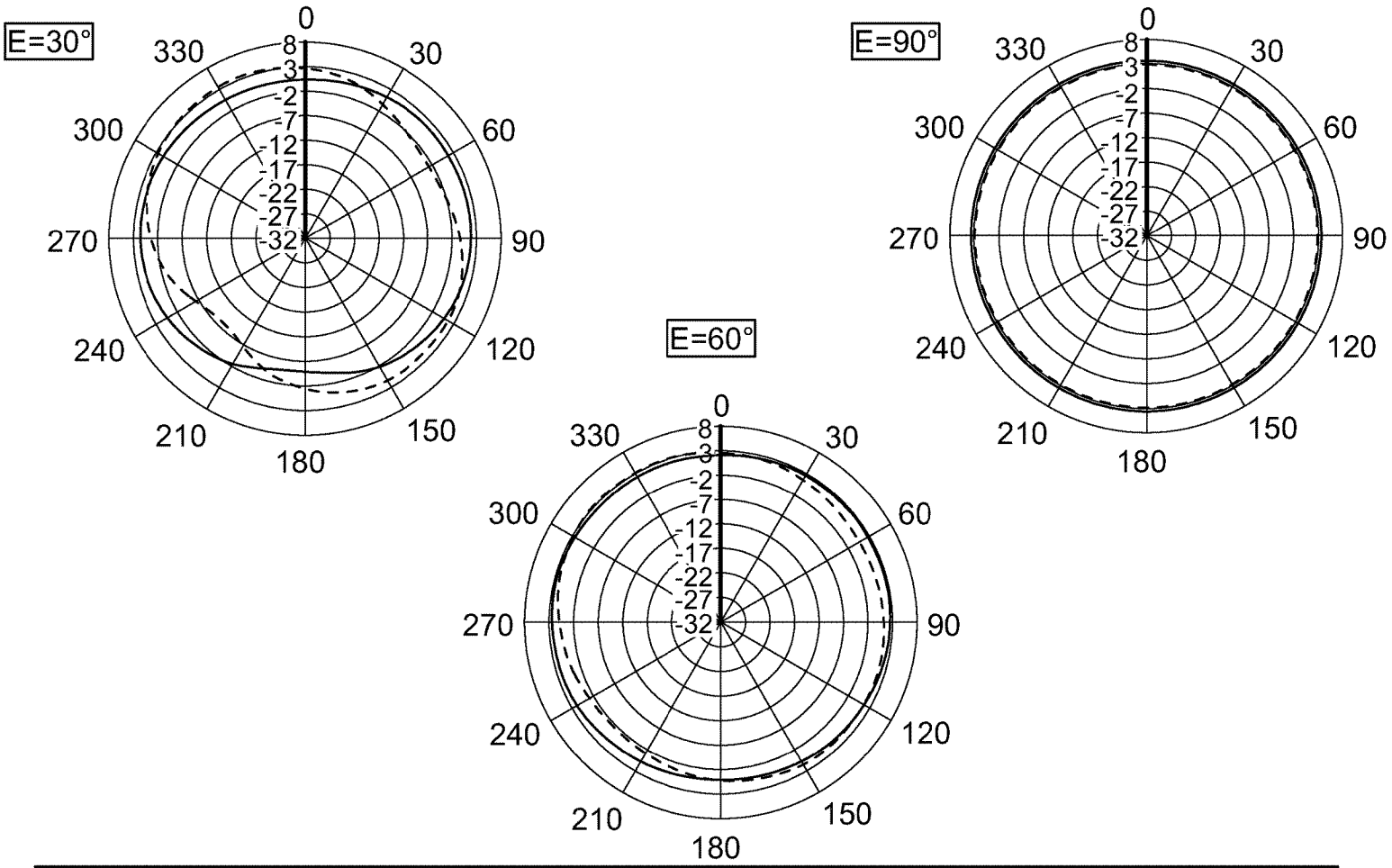
FIG. 11 illustrates radiation patterns of the GNSS patch antenna shown in FIGS. 7 through 9 at GNSS frequencies of 1559 MHz and 1606 MHz, at elevation angles of 30 degrees, 60 degrees, and 90 degrees with right circular (RC) polarization.

FIG. 11 illustrates radiation patterns of the top patch antenna 204 shown in FIGS. 7 through 9 at GNSS frequencies of 1559 MHz and 1606 MHz, at elevation angles of 30 degrees, 60 degrees, and 90 degrees with right circular (RC) polarization. Generally, FIG. 11 shows that the top patch antenna 204 had good omnidirectional radiation patterns at these GNSS frequencies and elevation angles.

FIG. 12 is a line graph of average gain in decibels isotropic circular (dBic) versus elevation angle in degrees for the lower patch antenna 236 shown in FIGS. 7 through 9 at SDARS frequencies of 2332 MHz, 2338 MHz, and 2345 MHz with left circular (LC) polarization for elevation angles from 15 degrees to 90 degrees and vertical (V) polarization for elevation angles from 0 degrees to 10 degrees. Generally, FIG. 12 shows that the lower patch antenna 236 had good average gain of at least 1 dBic at these SDARS frequencies for elevation angles greater than 20 degrees that surpassed the INTEROP SX-9845-0105-02 specifications.

FIG. 13 illustrates radiation patterns of the lower patch antenna 236 shown in FIGS. 7 through 9 at SDARS frequencies of 2320 MHz and 2345 MHz, at elevation angles of 30 degrees, 60 degrees, and 90 degrees with left circular (LC) polarization. Generally, FIG. 13 shows that the lower patch antenna 236 had good omnidirectional radiation patterns at these SDARS frequencies and elevation angles.

Accordingly, exemplary embodiments are disclosed herein of patch antennas, stacked patch antenna assemblies, and vehicular antenna assemblies. In an exemplary embodiment, a patch antenna includes a dielectric substrate having a bottom, a top, and sides extending generally between the top and bottom of the dielectric substrate. A ground is along the bottom of the dielectric substrate. An antenna structure is along the top of the dielectric substrate. The antenna structure also extends at least partially along one or more sides of the dielectric substrate.

The dielectric substrate may include four sides. The antenna structure may be disposed along an entire top surface defined by the top of the dielectric substrate. The antenna structure may be disposed at least partially along each of the four sides of the dielectric substrate.

The dielectric substrate may taper in a direction from the bottom to the top such that the top has a surface area less than a surface area of the bottom. The antenna structure may be configured to have a surface area larger than the surface area of the top of the dielectric substrate.

The sides of the dielectric substrate may include side portions configured to approach each other in a direction from the bottom to the top of the dielectric substrate such that the dielectric substrate tapers along the side portions. The antenna structure may be disposed at least partially along the side portions of the dielectric substrate. The bottom of the dielectric substrate may include or define a generally flat or planar bottom surface of the dielectric substrate. The top of the dielectric substrate may define or include a generally flat or planar top surface of the dielectric substrate that is generally parallel with the bottom surface of the dielectric substrate.

The side portions may comprise upper side portions that are non-parallel with each other and that extend linearly from corresponding edges of the top surface at an obtuse angle relative to the top surface of the dielectric substrate. The sides of the dielectric substrate may further comprise lower side portions that extend linearly between the upper side portions and the bottom of the dielectric substrate. The lower side portions may be generally parallel to each other and generally perpendicular to the bottom surface of the dielectric substrate.

Each side of the dielectric substrate may have a generally hexagonal perimeter cooperatively defined by an edge of the top surface, an edge of the bottom surface, and opposing pairs of the upper and lower side portions of the dielectric substrate.

A bottom portion of the dielectric substrate including the bottom and the lower side portions may cooperatively define a rectangular prism or cuboid. A top portion of the dielectric substrate including the top and the upper side portions may cooperatively define a truncated square pyramid, truncated right regular pyramid, right frustum, square frustum, or pyramidal frustum of a square pyramid.

The patch antenna may be configured to be operable for receiving Global Navigation Satellite System (GNSS) signals or frequencies and/or with frequencies from about 1559 MHz to 1610 MHz. The patch antenna may be configured to have a length of about 25 millimeters, a width of about 25 millimeters, and a thickness of the about 7 millimeters. The ground may comprise a metallization along the bottom of the dielectric substrate. The antenna structure may comprise a metallization along the top of the dielectric substrate and at least partially along at least one of the sides of the dielectric substrate.

In another exemplary embodiment, a stacked patch antenna assembly includes the patch antenna. The patch antenna is a first patch antenna configured to be operable for receiving satellite signals. The stacked patch antenna assembly further comprises a second patch antenna configured to be operable for receiving satellite signals different than the satellite signals received by the first patch antenna. The first patch antenna is stacked on top of the second patch antenna.

The first patch antenna may be configured to be operable for receiving Global Navigation Satellite System (GNSS) signals or frequencies and/or with frequencies from about 1559 MHz to 1610 MHz. The second patch antenna may be configured to be operable for receiving satellite digital audio radio services (SDARS) signals and/or with frequencies from 2320 MHz to 2345 MHz.

In a further exemplary embodiment, a multiband multiple input multiple output (MIMO) vehicular antenna assembly includes the patch antenna. The patch antenna is first patch antenna configured to be operable for receiving satellite signals. The vehicular antenna assembly further comprises a second patch antenna configured to be operable for receiving satellite signals different than the satellite signals received by the first patch antenna. The first patch antenna is stacked on top of the second patch antenna.

The vehicular antenna assembly may further comprise a chassis, a radome, a first cellular antenna, and a second cellular antenna. The first cellular antenna may be configured to be operable with communication signals within one or more cellular frequency bands. The second cellular antenna may be configured to be operable with communication signals within one or more cellular frequency bands. The first and second patch antennas and the first and second cellular antennas may be within an interior space cooperatively defined by or between the chassis and the radome.

The radome may have a shark-fin configuration. The vehicular antenna assembly may further comprise a printed circuit board supported by the chassis and within the interior space cooperatively defined by or between the chassis and the inner surface of the radome. The first patch antenna may be configured to be operable for receiving Global Navigation Satellite System (GNSS) signals or frequencies and/or with frequencies from about 1559 MHz to 1610 MHz. The second patch antenna may be configured to be operable for receiving satellite digital audio radio services (SDARS) signals and/or with frequencies from 2320 MHz to 2345 MHz. The first cellular antenna may be configured to be operable with Long Term Evolution (LTE) frequencies. The second cellular antenna may be configured to be operable with Long Term Evolution (LTE) frequencies. The vehicular antenna assembly may be configured to be installed and fixedly mounted to a body wall of a vehicle after being inserted into a mounting hole in the body wall from an external side of the vehicle and nipped from an interior compartment side of the vehicle.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband multiple input multiple output (MIMO) vehicular antenna assembly comprising a patch antenna including:

a dielectric substrate having a bottom, a top, and sides extending generally between the top and bottom of the dielectric substrate;

a ground along the bottom of the dielectric substrate; and an antenna structure along the top of the dielectric substrate and extending at least partially along at least one of the sides of the dielectric substrate;

wherein:

the patch antenna is a first patch antenna configured to be operable for receiving satellite signals;

the vehicular antenna assembly further comprises a second patch antenna configured to be operable for receiving satellite signals different than the satellite signals received by the first patch antenna; and the first patch antenna is stacked on top of the second patch antenna.

2. The vehicular antenna assembly of claim 1, wherein:

the dielectric substrate includes four sides; and the antenna structure is disposed along an entire top surface defined by the top of the dielectric substrate; and the antenna structure is disposed at least partially along each of the four sides of the dielectric substrate.

3. The vehicular antenna assembly of claim 1, wherein:

the sides of the dielectric substrate include side portions configured to approach each other in a direction from the bottom to the top of the dielectric substrate such that the dielectric substrate tapers along the side portions; and the antenna structure is disposed at least partially along the side portions of the dielectric substrate.

4. The vehicular antenna assembly of claim 1, wherein:

the patch antenna configured to be operable for receiving Global Navigation Satellite System (GNSS) signals or frequencies and/or with frequencies from about 1559 MHz to 1610 MHz; and the patch antenna is configured to have a length of about 25 millimeters, a width of about 25 millimeters, and a thickness of the about 7 millimeters; and the ground comprises a metallization along the bottom of the dielectric substrate, and the antenna structure comprises a metallization along the top of the dielectric substrate and at least partially along at least one of the sides of the dielectric substrate.

5. The vehicular antenna assembly of claim 1, further comprising:

a chassis;

a radome;

a first cellular antenna configured to be operable with communication signals within one or more cellular frequency bands; and a second cellular antenna configured to be operable with communication signals within one or more cellular frequency bands; and the first and second patch antennas and the first and second cellular antennas are within an interior space cooperatively defined by or between the chassis and the radome.

6. The vehicular antenna assembly of claim 5, wherein:

the radome has a shark-fin configuration;

the vehicular antenna assembly further comprises a printed circuit board supported by the chassis and within the interior space cooperatively defined by or between the chassis and the inner surface of the radome;

the first patch antenna is configured to be operable for receiving Global Navigation Satellite System (GNSS) signals or frequencies and/or with frequencies from about 1559 MHz to 1610 MHz;

the second patch antenna is configured to be operable for receiving satellite digital audio radio services (SDARS) signals and/or with frequencies from 2320 MHz to 2345 MHz;

the first cellular antenna is configured to be operable with Long Term Evolution (LTE) frequencies;

the second cellular antenna is configured to be operable with Long Term Evolution (LTE) frequencies; and the vehicular antenna assembly is configured to be installed and fixedly mounted to a body wall of a vehicle after being inserted into a mounting hole in the body wall from an external side of the vehicle and nipped from an interior compartment side of the vehicle.

7. A multiband multiple input multiple output (MIMO) vehicular antenna assembly comprising a patch antenna including:

a dielectric substrate having a bottom, a top, and sides extending generally between the top and bottom of the dielectric substrate;

a ground along the bottom of the dielectric substrate; and an antenna structure along the top of the dielectric substrate and extending at least partially along at least one of the sides of the dielectric substrate;

wherein:

the dielectric substrate tapers in a direction from the bottom to the top such that the top has a surface area less than a surface area of the bottom; and the antenna structure is configured to have a surface area larger than the surface area of the top of the dielectric substrate.

8. The vehicular antenna assembly of claim 7, wherein:

the patch antenna is a first patch antenna configured to be operable for receiving satellite signals;

the vehicular antenna assembly further comprises a second patch antenna configured to be operable for receiving satellite signals different than the satellite signals received by the first patch antenna; and the first patch antenna is stacked on top of the second patch antenna.

9. A multiband multiple input multiple output (MIMO) vehicular antenna assembly comprising a patch antenna including:

a dielectric substrate having a bottom, a top, and sides extending generally between the top and bottom of the dielectric substrate;

a ground along the bottom of the dielectric substrate; and an antenna structure along the top of the dielectric substrate and extending at least partially along at least one of the sides of the dielectric substrate;

wherein:

the sides of the dielectric substrate include side portions configured to approach each other in a direction from the bottom to the top of the dielectric substrate such that the dielectric substrate tapers along the side portions;

the antenna structure is disposed at least partially along the side portions of the dielectric substrate;

the bottom of the dielectric substrate includes or defines a generally flat or planar bottom surface of the dielectric substrate;

the top of the dielectric substrate defines or includes a generally flat or planar top surface of the dielectric substrate that is generally parallel with the bottom surface of the dielectric substrate;

the side portions comprise upper side portions that are non-parallel with each other and that extend linearly from corresponding edges of the top surface at an obtuse angle relative to the top surface of the dielectric substrate; and the sides of the dielectric substrate further comprise lower side portions that extend linearly between the upper side portions and the bottom of the dielectric substrate, wherein the lower side portions are generally parallel to each other and generally perpendicular to the bottom surface of the dielectric substrate.

10. The vehicular antenna assembly of claim 9, wherein each side of the dielectric substrate has a generally hexagonal perimeter cooperatively defined by an edge of the top surface, an edge of the bottom surface, and opposing pairs of the upper and lower side portions of the dielectric substrate; and/or wherein:

a bottom portion of the dielectric substrate including the bottom and the lower side portions cooperatively defines a rectangular prism or cuboid; and a top portion of the dielectric substrate including the top and the upper side portions cooperatively define a truncated square pyramid, truncated right regular pyramid, right frustum, square frustum, or pyramidal frustum of a square pyramid.

11. A patch antenna comprising:

a dielectric substrate having a bottom, a top, and sides extending generally between the top and bottom of the dielectric substrate;

a ground along the bottom of the dielectric substrate; and an antenna structure along the top of the dielectric substrate and extending at least partially along at least one of the sides of the dielectric substrate;

wherein:

the dielectric substrate tapers in a direction from the bottom to the top such that the top has a surface area less than a surface area of the bottom; and the antenna structure is configured to have a surface area larger than the surface area of the top of the dielectric substrate.

12. The patch antenna of claim 11, wherein:

the dielectric substrate includes four sides; and the antenna structure is disposed along an entire top surface defined by the top of the dielectric substrate; and the antenna structure is disposed at least partially along each of the four sides of the dielectric substrate.

13. The patch antenna of claim 11, wherein:

the sides of the dielectric substrate include side portions configured to approach each other in a direction from the bottom to the top of the dielectric substrate such that the dielectric substrate tapers along the side portions; and the antenna structure is disposed at least partially along the side portions of the dielectric substrate.

14. The patch antenna of claim 11, wherein:

the first patch antenna configured to be operable for receiving Global Navigation Satellite System (GNSS) signals or frequencies and/or with frequencies from about 1559 MHz to 1610 MHz; and the first patch antenna is configured to have a length of about 25 millimeters, a width of about 25 millimeters, and a thickness of the about 7 millimeters; and the ground comprises a metallization along the bottom of the dielectric substrate, and the antenna structure comprises a metallization along the top of the dielectric substrate and at least partially along at least one of the sides of the dielectric substrate.

15. A stacked patch antenna assembly comprising the patch antenna of claim 11, wherein:

the patch antenna is a first patch antenna configured to be operable for receiving satellite signals; and the stacked patch antenna assembly further comprises a second patch antenna configured to be operable for receiving satellite signals different than the satellite signals received by the first patch antenna; and the first patch antenna is stacked on top of the second patch antenna.

16. A patch antenna comprising:

a dielectric substrate having a bottom, a top, and sides extending generally between the top and bottom of the dielectric substrate;

a ground along the bottom of the dielectric substrate; and an antenna structure along the top of the dielectric substrate and extending at least partially along at least one of the sides of the dielectric substrate;

wherein:

the sides of the dielectric substrate include side portions configured to approach each other in a direction from the bottom to the top of the dielectric substrate such that the dielectric substrate tapers along the side portions;

the antenna structure is disposed at least partially along the side portions of the dielectric substrate;

the bottom of the dielectric substrate includes or defines a generally flat or planar bottom surface of the dielectric substrate;

the top of the dielectric substrate defines or includes a generally flat or planar top surface of the dielectric substrate that is generally parallel with the bottom surface of the dielectric substrate;

the side portions comprise upper side portions that are non-parallel with each other and that extend linearly from corresponding edges of the top surface at an obtuse angle relative to the top surface of the dielectric substrate; and the sides of the dielectric substrate further comprise lower side portions that extend linearly between the upper side portions and the bottom of the dielectric substrate, wherein the lower side portions are generally parallel to each other and generally perpendicular to the bottom surface of the dielectric substrate.

17. The patch antenna of claim 16, wherein:

the dielectric substrate tapers in a direction from the bottom to the top such that the top has a surface area less than a surface area of the bottom; and the antenna structure is configured to have a surface area larger than the surface area of the top of the dielectric substrate.

18. The patch antenna of claim 16, wherein each side of the dielectric substrate has a generally hexagonal perimeter cooperatively defined by an edge of the top surface, an edge of the bottom surface, and opposing pairs of the upper and lower side portions of the dielectric substrate; and/or wherein:

a bottom portion of the dielectric substrate including the bottom and the lower side portions cooperatively defines a rectangular prism or cuboid, and a top portion of the dielectric substrate including the top and the upper side portions cooperatively define a truncated square pyramid, truncated right regular pyramid, right frustum, square frustum, or pyramidal frustum of a square pyramid.

19. A stacked patch antenna assembly comprising:

a first patch antenna configured to be operable for receiving satellite signals; and a second patch antenna configured to be operable for receiving satellite signals different than the satellite signals received by the first patch antenna;

wherein:

the first patch antenna is stacked on top of the second patch antenna; and the first patch antenna includes a dielectric substrate having a bottom, a top, and sides extending generally between the top and bottom of the dielectric substrate, a ground along the bottom of the dielectric substrate, and an antenna structure along the top of the dielectric substrate and extending at least partially along at least one of the sides of the dielectric substrate.

20. The stacked patch antenna assembly of claim 19, wherein:

the dielectric substrate includes four sides;

the antenna structure is disposed along an entire top surface defined by the top of the dielectric substrate;

the antenna structure is disposed at least partially along each of the four sides of the dielectric substrate;

the dielectric substrate tapers in a direction from the bottom to the top such that the top has a surface area less than a surface area of the bottom; and the antenna structure is configured to have a surface area larger than the surface area of the top of the dielectric substrate;

the first patch antenna is configured to be operable for receiving Global Navigation Satellite System (GNSS) signals or frequencies and/or with frequencies from about 1559 MHz to 1610 MHz; and the second patch antenna is configured to be operable for receiving satellite digital audio radio services (SDARS) signals and/or with frequencies from 2320 MHz to 2345 MHz.

* * * * *